United States Patent [19]

Renjilian

[11] Patent Number: 4,569,883

[45] Date of Patent: Feb. 11, 1986

[54] PAPER MACHINE CLOTHING

[75] Inventor: Armen Renjilian, Colonie, N.Y.

[73] Assignee: Albany International Corp., Albany, N.Y.

[21] Appl. No.: 693,033

[22] Filed: Jan. 22, 1985

[51] Int. Cl.[4] ..... B32B 5/02

[52] U.S. Cl. ..... 428/234; 139/383 A; 162/DIG. 1; 428/240; 428/244; 428/246; 428/257; 428/283; 428/305.5; 428/398; 428/905

[58] Field of Search ..... 428/234, 240, 257, 258, 428/250, 284, 283, 398, 241, 905, 244, 246, 300, 305.5; 427/11; 139/383 A; 162/DIG. 1

[56] References Cited

U.S. PATENT DOCUMENTS

| | | | |
|---|---|---|---|
| 4,357,386 | 11/1982 | Luciano et al. | 428/240 |
| 4,433,024 | 2/1984 | Ean | 428/244 |
| 4,455,187 | 6/1984 | Blücher et al. | 428/244 |
| 4,460,641 | 7/1984 | Barer | 428/300 |

*Primary Examiner*—James J. Bell

*Attorney, Agent, or Firm*—Kane, Dalsimer, Kane, Sullivan and Kurucz

[57] ABSTRACT

The disclosure is of paper machine clothing which includes a means of chemically treating the fabric of the clothing.

7 Claims, 7 Drawing Figures

FIG.5
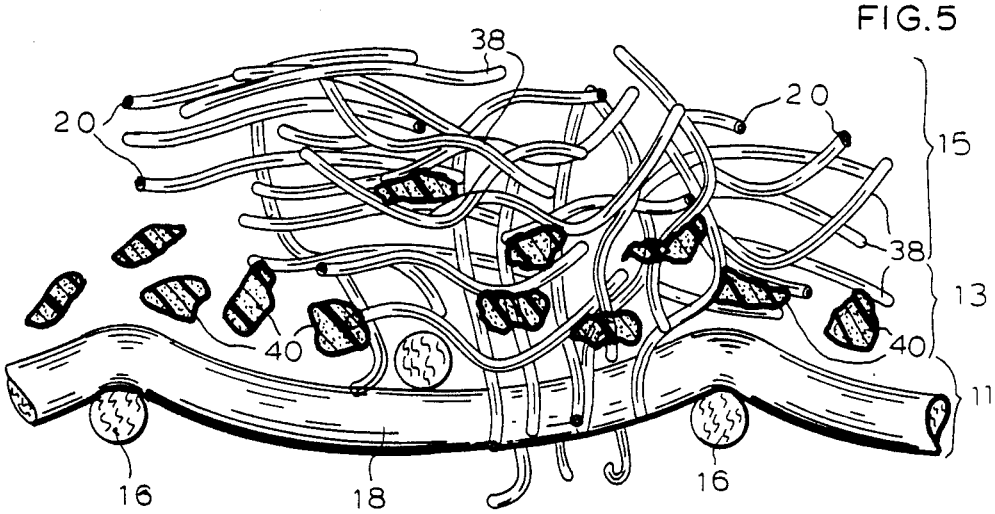
FIG.6
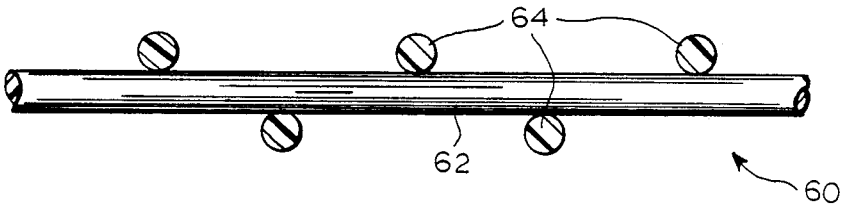
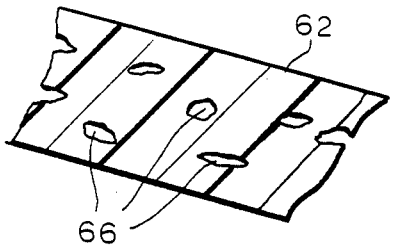
FIG.7

PAPER MACHINE CLOTHING

BACKGROUND OF THE INVENTION

1. Field of the Invention

The invention relates to paper machine clothing useful for fabrication of dryer belts, employed in the dryer section of a papermaking machine, wet belts employed in the press section of such machines and forming wires which may be used on fourdrinier and cylinder machines and more particularly relates to such fabrics made from spun yarn, multi-and monofilaments of synthetic polymer resins and including a means for chemical treatment during their use.

2. Brief Description of the Prior Art

Papermaking machines are well known in the art. The modern papermaking machine is in essence a device for removing water from the paper furnish. The water is removed sequentially in three stages or sections of the machine. In the first or forming section, the furnish is deposited on a moving forming wire and water drained through the wire to leave a paper sheet or web having a solids content of circa 18 to 25 percent by weight. The formed web is carried into a wet press felt section and passed through one or more nip presses on a moving press felt to remove sufficient water to form a sheet having a solids content of 36 to 44 percent by weight. This sheet is transferred to the dryer section of the papermaking machine where dryer felts press the paper sheet to hot steam heated cylinders to obtain a 92 to 96 percent solids content.

On papermaking machines, endless belts are employed in the various sections to carry the sheet or web of paper. There are a wide variety of forms of the endless belts, some fabricated from metal and others from textile material such as cotton, cotton and asbestos or cotton, asbestos and synthetic fibrous or filamentous materials. The selection of a given material is dependent to some degree upon the use to which the fabric will be put, i.e.; as a forming fabric, dryer felt, etc.

One form of belt which has been used extensively as a forming wire in the forming section of the papermaking machine is one fabricated from an open weave of synthetic, polymeric resin monofilaments. Such fabrics generally perform well in the forming section although there are certain limitations. For example, the resin monofilaments have an affinity for accumulating a build-up of pitch, tars and other contaminants during use. This shortens the overall life of the forming wire and requires frequent halts of its papermachine for cleaning and application of inhibiting chemicals. This shut-down cleaning may be required as frequently as on a weekly basis.

Dryer belts for use in the drying section of the papermaking machine have historically been fabricated from dryer felt fabrics. In recent years, one form of belt commonly employed in the dryer section of a papermaking machine is referred to as a "screen" and is fabricated by weaving synthetic monofilaments or twisted multi-filaments together in an open weave. Although not subjected to any form of milling, and therefore not "felts" in the original sense of the term, these screen fabrics have also become known as "dryer felts". The endless belts are generally woven flat and the ends thereafter joined to form an endless belt. The weave selected may be a two or three layer weave of synthetic yarns such as multifilament, spun or monofilament yarns.

In carrying the formed paper web through the dryer section of the papermaking machine, the felt aids in drying, controls shrinkage of the paper web and prevents cockles. The felt fabric must possess strength, dimensional stability, resistance to chemical and thermal degradation, resistance to abrasion and have a functional permeability. In recent years all monofilament structured fabrics have been developed to meet the above-described needs of a dryer felt. However, dryer felts fabricated from all monofilament fabrics, like forming wires, accumulate deposits of pitch, tar and other contaminants such as paper duct. Shut-down cleaning may be required as frequently as every 2–3 weeks and cleaning over a long period of time may become less effective as filling of the felt voids continues. This of course may be highly undesirable, resulting in a high percentage of unsatisfactory paper product.

Those skilled in the art have long appreciated that the efficiency of water removal in the wet press section of the papermaking machine is critical to overall efficiency in the papermaking process. This is because, first a large amount of water must be removed from the sheet at the presses to realize a good drying economy. Secondly, greater efficiency in water removal creates a drier and hence stronger sheet less susceptible to breaking. A large variety of clothing constructions have been proposed as papermaker's felts advantageously employed in the press section of a papermaking machine. In fact, there has been a continual evolution of clothing constructions, corresponding to improvements in the papermaking machine itself. This evolution began with the early woven felt, woven of spun yarn and then mechanically felted or fulled. A later development was found in the "Batt-on-Base" construction consisting of a woven fabric base and a batt surface attached by needling. The needled batt-on-base felts are widely used today and have been said to be the "standard of the industry". However, a wide variety of other constructions are available, including non-woven press felts and composite laminates which comprise a fabric substrate with a surface layer of a flexible, open-cell, polymeric resin foam; see for example the disclosures found in U.S. Pat. Nos. 1,536,533; 2,038,712; 3,059,312; 3,399,111; and 3,617,442. In general, the papermakers wet-press felt fabrics, like forming wires and dryer fabrics, require periodic chemical treatment or cleaning to remove debris or contaminants which accumulate during use. Certain chemical additives are also advantageously used during initial break-in periods. For example, it is common knowledge to use small amounts of a detergent applied through a full width shower on wet-press felts during the application of a felt, i.e., the pressing of water through a press roll. The use of such a detergent shower is intended for conditioning a wet-press felt to be more absorbent to water and thus aid a felt in keeping clean and draining properly. We also know from prior art that the use of free detergent dissolved in the stock water aids in pressing water from the sheet of paper being produced.

Using the concepts taught by the present invention, the surfactant is at the point of application since it is being carried in the felt itself going through the press nip.

Dispensing of small quantities of surfactant throughout the life of the wet-press felt is ideal. However, since difficulty in pressing water from paper is mostly experienced in the initial few days and during the compaction of the felt to its equilibrium caliper, the addition of surfactant during this break-in period is essential. During break-in and compaction, it is also important to keep the felt clean such that paper stock particles are not trapped within the felt causing the disruption of channels in normal felt drainage. The surfactant would act as a cleaning agent as well. It is also possible to minimize cost, and foam buildup since this method reduces amount needed because dispensing of the surfactant is controlled.

With the structured fabrics of the present invention, many of the above-described shortcomings of the prior art are removed. Dryer belts constructed according to the invention may be fabricated from an all monofilament fabric which provides for extended periods of time an exceptionally smooth surface to contact the paper sheet. As a result, relatively mark free paper product is obtained, while all of the desired advantages of an all monofilament dryer felt are retained.

Wet-press felt fabrics are broken-in more rapidly and require less frequent shut-down cleaning, thereby raising the efficiency of the papermaker's machine over periods of time. The overall operating life of the forming wires and felts is significantly increased over prior art wires and felts.

It will be appreciated that there is an extensive range of prior art descriptions in the field of papermaker's fabrics. Representative of such descriptions are those found in U.S. Pat. Nos. 2,260,940; 2,354,435; 2,748,445; 3,060,547; 3,158,984; and British Pat. No. 980,288.

SUMMARY OF THE INVENTION

The invention comprises a papermachine clothing fabric, which comprises;

interwoven machine direction and cross-machine direction yarns comprising paper machine clothing, including means for the slow, sustained release of a chemical compound for treating said clothing.

BRIEF DESCRIPTION OF THE DRAWINGS

FIG. 5 is a cross-sectional, exploded side elevation of a portion of a preferred embodiment wet-press felt fabric of the invention.

FIG. 6 is an exploded, cross-sectional side elevation of a portion of a preferred embodiment forming wire of the invention.

FIG. 7 is an enlarged view of a portion of a yarn component shown in FIG. 6.

DETAILED DESCRIPTION OF THE PREFERRED EMBODIMENTS OF THE INVENTION

The preferred embodiments of the invention will be described hereinafter in conjunction with the accompanying drawings of FIGS. 1–7, inclusive.

Figure 1:
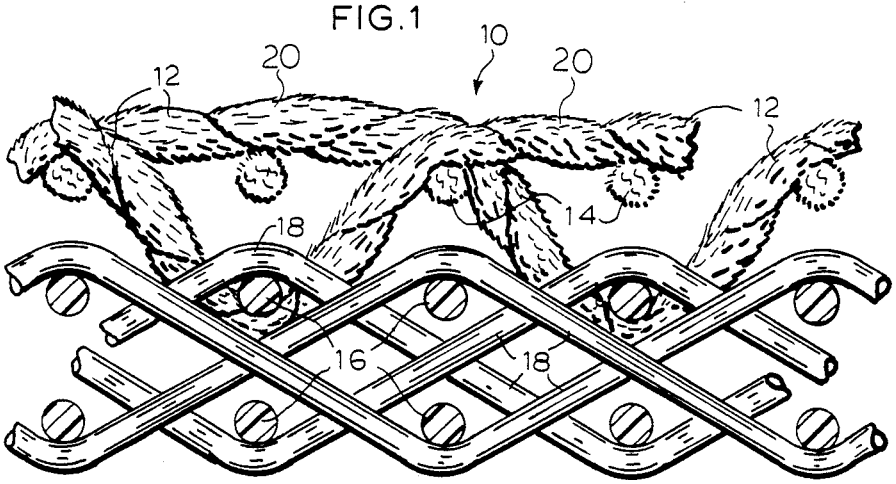
FIG. 1 is an enlarged, cross-sectional side elevation of a portion of an embodiment dryer fabric of the invention.

Referring now to FIG. 1, an enlarged, cross-sectional side elevation is seen of a portion of a length of embodiment dryer fabric 10 of the invention. The fabric is a multilayer fabric, free of binder yarns. The upper, surface layer of the fabric on the sheet side consists of a single layer of interwoven spun yarns formed by the weaving of lengthwise or warp spun yarns 12 and crosswise or filler spun yarns 14. The spun yarns 12, 14 may be conventionally spun from hollow fibers or blends of hollow fibers with heat resistant, natural or synthetic staple fibers such as fibers of polyester, polyamide, polyacrylic, wool and like fibers and blends thereof. The yarns 12, 14 may also be multifilament yarns containing a proportion of blended hollow fibers.

The term "hollow fiber" as used throughout the specification and claims means synthetic textile fibers which are hollow and which may have open or closed ends. Hollow fibers and methods of their manufacture are well known; see for example U.S. Pat. Nos. 2,399,259; 3,389,548; 3,723,238; 3,772,137; and 4,109,038. The fibers may be fabricated from a wide variety of synthetic polymeric resins such as polyamides, polyesters, polyacrylics, polyolefins like polyethylene and polypropylene, polyaramids and the like. The hollow fibers may be used along or in blends with other staple textile fibers.

Those skilled in the art will appreciate that the degree of softness desired in the fabric 10 surface may be controlled by selection of particular fibers in the yarns and by the amount of twist put into the yarns during their preparation. The yarns may have a size ranging from 100 grains to 3,000 grains per 100 yards.

Figure 2:
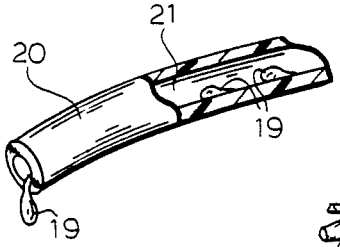
FIG. 2 is a further enlarged, partially cut-away view of a fiber component of the fabric shown in FIG. 1.

The soft, spun yarn surface of hollow fibers provides a heat barrier (insulation) for the dryer fabric 10 of the invention and protect the monofilament base (described hereinafter) which is otherwise susceptible to degradation by exposure to the high temperature generated by the papermachine drying cylinders. The improved insulative barrier provided by the hollow fibers is due to their unique structure as shown in FIG. 2, an enlarged, partially cut-away view of a fiber 20 component of the yarns 12, 14 as shown in FIG. 1. The hollow fiber 20 shown is tubular in configuration and will have open ends (open end shown in FIG. 2).

As also shown in FIG. 1, the base of the fabric 10 consists of a duplex type weave of lengthwise (warp) monofilament yarns 18 and crosswise (weft) monofilament yarns 16. The base of interwoven monofilament yarns provides a high degree of stability and structural integrity to the dryer fabric 10 of the invention. Any commercially available monofilament yarns having a diameter within the range of from about 0.008 to 0.040 inches may be advantageously employed as the yarns 16, 18. Representative of such yarns 16, 18 are monofilaments of polyamide, polyester, polyropylene, polyimide and the like. A number of lengthwise yarns 18 may be provided having loops at the fabric ends. The loops are formed by conventional techniques well known to those skilled in the art and provide a means of forming a joinder and pin seam between ends of the fabric 10 to provide an endless belt of fabric 10.

As stated above, the preferred fabric 10 of the invention is a unitary, multi-layer structure free of binder yarns. The yarns 12, 14 are integrated with the base yarns 16, 18 by a lengthwise yarn 12 which occasionally dips to interweave with a crosswise monofilament yarn 16 in the fabric base as shown in the FIG. 1, thereby providing what is commonly referred to in the art as a "stitching point". The entire fabric structure 10 may be characterized as a smooth faced, multi-layer weave. The fabric 10 may be woven on a conventional papermakers felt loom in a single operation. The base yarns 16, 18 are woven while the spun yarns 12, 14 are woven directly above the base yarns 16, 18. The combining of the two yarn systems is performed during the weaving operation by sinking one of the spun yarns 12 to interlace with one of the monofilament base yarns 16 to provide the stitching points. The combining of the two systems is preferably in a set sequence, for example on every other crosswise yarn 16 so as not to distort either the upper spun yarn surface or the monofilament yarn base.

The density of the warp yarns in the woven fabric of the invention would depend on the size of the yarn selected and may advantageously range from between 10 to 180 warp ends to the inch. Similarly, the number of crosswise or filling yarns may be between 10 to 60 yarns per inch. Within these density ranges, the upper surface (including hollow fibers) acts as a heat barrier as the dryer fabric 10 passes over steam heated cylinders or under hot air ducts to dry sheets of paper being conveyed thereon. The density ranges described above also assure that the sheet surface will be non-marking towards paper being conveyed thereon.

Figure 3:
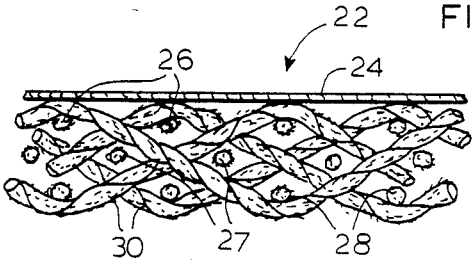
FIG. 3 is an enlarged, cross-sectional side elevation of a portion of an alternate embodiment fabric of the invention.

FIG. 3 is an enlarged, cross-sectional side elevation of a portion of a dryer fabric 22 of the invention supporting a sheet of formed paper 24. The fabric 22 has two yarn systems and is woven or joined at its ends to form an endless belt. The yarns 26, 27, 28 extend in the machine direction of the belt comprise the weft of the fabric while the yarns 30, interwoven with yarns 26, 27, 28 comprise the warp yarns. The fabric 22 comprises 2 layers, that is a layer of interwoven yarns 26, 30 facing the paper sheet 24 to be dried and a lower weft layer of interwoven yarns 28, 30 facing away from the paper sheet 24. The yarns 26, 27, 28 may be spun yarns or multifilament yarns of hollow fibers or blends of staple fibers with hollow fibers. Advantageously, the yarns 26, 30 will be made to include hollow fibers having deniers of 3 to 15 and a length of circa 1" to 6" while the yarns 27,28 will contain hollow fibers with a denier of 5 to 30. The weave of fabric 22 should be sufficiently dense to provide a smooth, non-marking surface.

Figure 4:
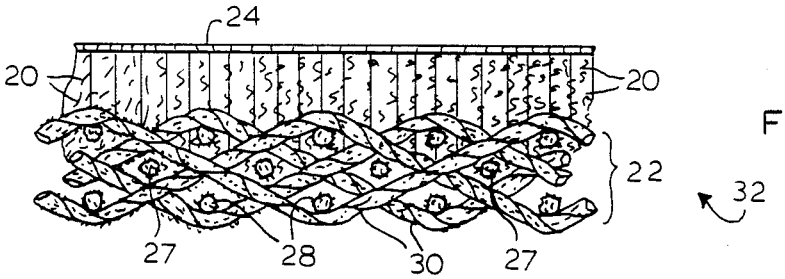
FIG. 4 is an enlarged, cross-sectional side elevation of a portion of still portion of still another embodiment fabric of the invention.

FIG. 4 is an enlarged cross-sectional side elevation of a portion of another embodiment fabric 32 of the invention which comprises a modification of the fabric 22 described above. As shown in FIG. 4, the modification comprises needling a batt 34 of non-woven, textile fibers to the sheet side of the fabric 22.

The batt 34 may comprise a blend of wool fibers and synthetic fibers or it may be composed completely of synthetic fibers or completely of hollow fibers or a blend of hollow and not hollow fibers. In a way known per se the batt may also comprise melt fibers, i.e. synthetic fibers which have a lower melt point than the rest of the fibers in the batt. After the needling of the batt into the outer layer of fabric 22, the batt 34 is heated, e.g. by means of hot air jets or contact with a hot cylinder to a temperature above the plastification point of these fibers whereby fibers at points melt together with the rest of the fibers in the batt at the contact points of the fibers. At the same time, the machine cloth should be exposed to an evenly distributed pressure from above which gives a certain remaining compression of the batt layer. Due to the melting together of the fibers only at points of the fibers in the batt layer, the machine cloth retains its openness. The method to attach, by means of needling, a batt with or without a subsequent heating and a certain compression is well known and gives a smooth super surface to the finished fabric 32.

In accordance with the present invention, the hollow fibers 20 of the above described dryer fabrics 10, 22 and 32 contain a fluid chemical 19 within the lumen 21 of the fiber 20 (see FIG. 2). The means of incorporating the fluid chemical 19 within the open lumen 21 is well known; see for example U.S. Pat. No. 3,389,548.

The fluid chemical 19 may be any chemical usefully applied to the fabrics 10, 22, 32 during their operation as a dryer belt on a papermaking machine. For example, petroleum solvents, non-ionic detergents and emulsions of petroleum solvents may be employed as the chemical 19. During operation of the dryer felt, the chemical 19 is slowly released from the open ends of the fibers 20 to inhibit the build-up or accumulation of pitch and tar, as described above.

Representative of the papermaker's wet-press felts of the invention is the embodiment felt fabric 50 shown in FIG. 5, an exploded cross-sectional, side elevation. The FIG. 5 shows schematically three layers in the fabric 50. The base layer 11 may be any conventional press felt fabric. As shown in FIG. 5, the base layer 11 is preferably of interwoven machine direction (warp) 18 and cross-machine direction (weft) 16 textile monofilament yarns as previously described. The yarns 16, 18 may also be spun yarns, spun from synthetic or natural staple fibers such as staple fibers of wool, cotton, polyolefins, polyamides, polyesters, mixtures thereof and the like. Alternatively, the yarns 16, 18 may be multifilament yarns of the same synthetic or natural fiber materials.

The particular weave employed in providing the base layer 11 is not critical and any conventional felt weave may be employed including a textile base or a base layer 11 having only warp or only weft yarns. Thus, the base layer 11 may be a single layer or a multi-layered weave construction and may include filling yarns or picks to control permeability of the fabric 50.

Advantageously the denier of the yarns and the density of the weave is selected to provide a base layer 11 weight of from about 4 to about 30 oz./square yard for optimum strength.

An intermediate layer 13 consists of a plurality of discrete, granular particles 40 of a synthetic, polymeric resin foam. Preferably, the particles 40 have an average diameter of from about 0.3 to about 2 cm, most preferably about 1.25 cm. The particles 40 may be provided by chopping sheets of synthetic, flexible, polymeric resin foams. The term "foam" as used herein includes open cell foams of such synthetic polymeric resins as polyolefins such as foamed polyethylene, polyurethanes, including polyether and polyester foams, polyisocyanurate foams and the like. The method of preparing such foams and chopping them into particulate forms is well-known to those skilled in the art.

Immediately above the layer 13 of foam particles 40 is a layer 15 of non-woven, staple textile fibers 38. The layer 15 may be provided by a batt of the non-woven, staple fibers 38.

The batts may be of randomly oriented staple fibers such as synthetic polyamide, polyester, polyolefin, acrylic and like fibers including blends thereof and natural fibers such as jute and blends thereof. Optionally, if desired, the fibers may be directionally oriented within the batts by methods known to the art.

The batts of staple fibers selected for layer 15 advantageously have a weight of from about 2 to about 20 oz./square yard. The staple fibers may have a wide denier range. The batts may be preneedled using conventional techniques to obtain some integrity of the fibers prior to incorporation in the structure of fabric 50.

In one embodiment of the invention, a proportion of hollow fibers 20 as previously described may be blended in with the fibers 38 and may contain a chemical 19 for slow-sustained release of a chemical advantageously applied to the fabric 50 during operation of the fabric 50 in the form of a wet-press felt belt. In a preferred embodiment fabric 50 of the invention, the chemical 19 is a surfactant.

The term "surfactant" as used herein is a contraction of "surface-active agent" and is a broadly descriptive term used to describe a chemical compound which is (1) soluble in at least one phase of a system, (2) has an amphipathic structure, (3) the molecules of which form oriented monolayers at phase interfaces, (4) exhibits an equilibrium concentration as a solute at a phase interface, greater than its concentration in the bulk of the solution, (5) forms micelles when the concentration as a solute in solution, exceeds a characteristic limiting value and (6) exhibits some combination of the functional properties of detergency, foaming, wetting, emulsifying, solubilizing and dispersing. Surface-active agents are generally classed as anionic, cationic or non-ionic. Preferred as surface-active agents in the method of the invention are those of the non-ionic type. Non-ionic surface active agents are generally well-known as is the method of their preparation. Be presentative are the alkyl phenoxypoly (ethyleneoxy) ethanols such as the octylphenoxypoly (ethyleneoxy) ethanols and nonylphenoxypoly (ethyleneoxy) ethanols having polyoxyethylene moieties averaging from 8 to 15 units in length. Other non-ionic surfactants which may be employed are represented by polyethylene oxides, polypropylene oxides, long chain allkyl phosphine oxides, long chain alkylamine oxides and the like. The proportion of surface-active agent employed in the wetting medium may be within the range of from about 0.001 to 1 percent by weight of the medium, preferably around 0.2 percent.

The fabric 50 need not incorporate the chemical 19 in hollow fibers 20 as described above, but may alternatively contain the chemical 19 within the foam particles 40, for slow release into the fabric 50 during operation of the wet-press belt made up of fabric 50. Thus, one may impregnate the foam particles 40 with chemical 19 and eliminate the use of hollow fibers 20. Thus hollow fibers 20 and/or foam particles 40 are a means or mechanism for distributing chemicals, in particular surfactants, in the nip of a press to enhance dewatering.

Felts treated with such solutions of surfactant/wetting agents, resins and swelling agents maintain or slowly release the detergent. The properties of such fibers and felts show:

(a) improved wicking (capillarity)
(b) increased or changed water absorbtion as measured by demand wettability testing
(c) improved water removal from paper sheets
(d) decreased pressure drops across the felt caliper regardless of the flow rates measured.

Other chemicals may impart either hydrophobic or hydrophillic characteristics and may be filled into fiber voids such as hollow fibers and dispensed continuously and with control over the life of fabrics to help in improving the water removal capabilities of the fabrics used in papermaking applications.

The layers 11, 13 and 15 of fabric 50, although made up of independent materials, are all integrated and consolidated into a single, uniform fabric by needling. Needling forms a dense, fibrous fabric (for illustrative purposes, only a few fibers 38 have been shown in FIG. 5 entangled with the layers 11 and 13). There is a consolidation of the three layers 11, 13, 15 through entanglement of the fibers 38 with particles 40 and yarns 16, 18. This entanglement stabilizes and holds in position the otherwise loose particles 40 so that there is a homogeneous, stable fabric 50 structure. If fibrous batts are needled to only one side of the base layer over the intermediate layer 13, fibers are carried to the opposite side of the base layer 11 to produce a light "nap" on that side, incorporating the yarns. In another embodiment of the invention, fibrous batts are also needled to the lower surface of the textile base layer 11 to produce a thicker needled fabric. The embodiment fabric 50 of the present invention is a preferred construction for optimum strength, stability, water permeability and operating efficiency.

Techniques for needling composite structures are so well known that they need not be recited herein; see for example the needling techniques described in U.S. Pat. No. 2,059,132.

The coarseness of the felting needles used, the barb configurations, number, size and other variables are dependent somewhat on the degree of openness between the textile yarns, so as to avoid rupture of the textile yarns 18, 16. In general, we have found a No. 28 guage needle, with the barbs oriented so as not to tear the lengthwise yarns 18, adequate for needling. The needling frame may be fitted with either high or low density needle boards, a 34 density board being illustrative. Needling is preferably carried out to produce a needled fabric having a weight within the range of from about 20 to about 60 oz./square yard.

The above-described wet-press felt fabric 50 of the invention may be prepared by the general method described in U.S. Pat. No. 4,357,386. Alternate fabrics and the method of their fabrication are described in U.S. Pat. No. 4,267,227.

FIG. 6 is a cross-sectional exploded side elevation of a portion of a forming wire fabric 60 of the invention.

The monofilaments 62, 64 may be extruded monofilaments of any known synthetic, polymeric resin in any conventional denier. Representative of preferred monofilament yarns are monofilament yarns of polyesters, polyamides, polyaramids, polyolefins and the like which do not absorb high proportions of moisture. Preferably the monofilaments 62, 64 will have an average diameter of from about 0.008 to 0.04 inches to provide a high degree of stability and structural integrity in the fabric 60 of the invention. Preferably for a forming wire, low moisture absorption monofilament yarns are employed. FIG. 7 is an enlarged view of a portion of the monofilament 62, showing that it is porous, i.e.; it contains pores 66 therein. In accordance with this invention, the porous monofilament yarns 62, 64 contain a chemical 19 as previously described, for slow release during operation of a forming wire on a papermaking machine, and made from the fabric 60. The yarns 62, 64 are manufactured by adding the chemical 19 such as by adding surfactant to pelletized plastics, such as nylon, as an additive prior to extrusion. An 8 mil. nylon 6 monofilament product may be produced containing 2% by weight of various surfactants added to pellets prior to entrusion. The product is of good quality with no major problems encountered during its extrusion. The resulting monofilaments 62, 64 will slowly release the surfactant or other chemical 19 during operation of the forming wire made up of fabric 60. In this way, the accumulation of pitch and tar on the forming wire may be inhibited.

Also advantageously employed in this manner are anti-static compounds (as the chemical 19) to reduce static on the forming wire 60 of the invention. Representative of anti-static compounds are quaternary ammonium compounds and the like. Similarly, lubricants may be incorporate in the yarns 62, 64 for slow-release (see U.S. Pat. No. 4,217,324) in the fabric 60 of the invention.

Following the manufacture of the fabric 60 by interweaving yarns 62, 64 the fabric 60 is heat-set to stabilize the fabric and to draw the yarns into desired relative positions. The degree of heat-setting required to achieve the desired structure of the fabric 60 will of course vary depending on the polymer nature of the yarns 62 and 64. However, optimum times, temperatures and tensions placed on the fabric during heat-setting can be determined by those skilled in the art, employing trial and error technique for the different yarn materials. In general, heat-setting may be carried out at temperatures of from about 150 degrees F. to 400 degrees F. for from 15 to 60 minutes.

In summary, the invention provides a method of providing papermachine clothing with a slow, continual supply of concentrated surfactants or other chemicals that will improve clothing performance. Chemical release means when used in the construction of papermaker's fabrics, will act as reservoirs in dispensing small amounts of surfactant or other desired chemical during use on papermachines.

The following examples describe the manner and process of making and using the invention and set forth the best mode contemplated by the inventor of carrying out the invention but is not to be construed as limiting.

EXAMPLE 1

Dryer Fabric

There is provided a quantity of 0.020 inch diameter polyester monofilament and a quantity of 0.021 inch diameter polyamide (nylon) monofilament yarn. There is also provided a quantity of 500 grain per 100 yard size spun yarns composed of a blend of 75% hollow polyester fibers and 25% acrylic fibers. The hollow fibers have been filled with a non-ionic surfactant.

The monofilament yarns are woven together in a duplex pattern, i.e.; a double system of filling with a single system or warp yarns to form a base. The base is composed of two "ends" of the polyester monofilament and two "ends" of nylon monofilament alternating across the width of the fabric. Each "end" (warp) runs the length of the fabric. The spun yarn is simultaneously woven on top of the monofilament so as to cover each pair of monofilaments, alternate spun yarns dropping down to interlace with alternate crosswise monofilament.

The density of the monofilament warp yarns in the product is 48 ends to the inch in conjunction with 24 ends of spun yarn. The total end density is then 72 yarns to the inch. The number of "fillings" in the product is 25 monofilaments and 12½ spun yarns per inch for a total of 37½ fillings per inch.

The ends of the product are frayed to break the ends and monofilament loops handwoven back to provide a seamed structure. The ends are joined with a pin through the loops to obtain an endless belt. When installed on a paper machine as a dryer felt, the fabric performs well in the manufacture of relatively fragile papers. The belt tracks well, is easily guided and exhibits a long life even after exposure to temperatures of circa 250 degrees F. Cleaning of the belt is required less frequently than prior art belts.

EXAMPLE 2

Wet-Press Felt Fabric

A woven scrim made up of interwoven machine direction and cross-machine direction yarns (1.0 oz/ft$^2$) is covered on one surface with a batt of non-woven staple fibers having a weight of 3.2 oz/ft$^2$ and the two layers are joined by needling. The uncovered surface of the resulting felt is covered with granules (average diameter of 0.125") of a non-ionic surfactant impregnate polyurethane foam at a rate of 2.26 oz/ft$^2$ and the granules are covered with a batt of the above described non-woven fibers weighing 1.2 oz./ft$^2$. The whole assembly is needed together to obtain a wet-press fabric having the following physical properties:

weight
density
void volume
air permeability

EXAMPLE 3.

Forming Wire

A fabric is prepared in a weave of 0.020" diameter Polyamide (nylon 6) monofilament machine direction yarns totalling 56 ends per inch interwoven with 0.020" diameter monofilament polyamide (nylon 6) cross-machine direction yarns totalling 40 picks per inch (20 top and 20 bottom in a two layer weave). The yarns were extruded containing 2% by weight of a non-ionic surfactant. After heat-setting, a fabric is obtained which has a smooth surface contacting outer plane.

This fabric may be made endless through the use of the well-known joining procedure whereby the ends of the fabric are woven one into the other, or by the use of the pin seam. The fabric provides superior sheet support to result in greater machine efficiencies and improved dimensional stability for longer life. The wire requires less frequent cleaning than prior art wire not containing surfactant.

EXAMPLE 4

Activated charcoal was ground in a ball/mill dry to micron sizes and mixed with 1 gr of charcoal to 50 ml liquid detergent. The mixture was then diluted with alcohol to the proper viscosity and introduced into hollow monofilaments using vacuum technique. The purpose of the charcoal is to act as an absorbant to the detergent and thus slow down the release of detergent into the water phase. The procedure of Example 1, supra., was then repeated using the charcoal-surfactant mixture filled hollow fibers as the hollow fibers of Example 1. The fabric performs well as a dryer felt fabric.

Those skilled in the art will appreciate that many modifications of the preferred embodiments described above may be made without departing from the spirit and the scope of the invention. For example, the fabrics of the invention may be woven to include various stuffer picks, to obtain dryer and press fabrics of different permeabilities as will be appreciated by those skilled in the art.

The felts and forming wires of the invention may also be finished in any conventional manner, i.e.; for example surface chemical treatments to offer specific properties of runability and resistance to chemical and abrasive degradation.

What is claimed is:

1. A fabric for use as a paper machine clothing fabric which comprises;

plurality of machine-direction yarns interwoven with a plurality of cross- machine direction yarns; and means for the slow release of a chemical compound for chemically treating said clothing fabric included in the woven fabric.

2. The fabric of claim 1 wherein said means comprises:

at least one of said machine-direction and cross-machine direction yarns containing hollow fibers.

3. The fabric of claim 1 wherein said means comprises:

a granule of a polymeric resin foam impregnated with the compound.

4. In a papermachine dryer fabric, which comprises woven textile yarns, the improvement, which comprises;

hollow fibers structurally integrated in said fabric and containing a chemical compound for slow release into the fabric.

5. A wet press felt, which comprises:

a seamed endless fabric having a woven base containing synthetic polymere resin hollow fibers which contain a chemical for slow release into the fabric.

6. A forming wire, which comprises:

a seamed endless fabric of interwoven machine and cross-machine direction yarns, of synthetic polymeric resin monofilaments containing for slow release, a chemical for the treatment of the wire.

7. A papermakers wet-press felt, which comprises;

a textile base layer;

an intermediate layer of granular particles of a synthetic, flexible polymeric resin foam; and an upper layer for receiving a wet paper sheet affixed to the base layer and the intermediate layer by needling, said upper layer comprising a plurality of non-woven textile staple fibers; said foam containing a chemical for slow release into the felt.

* * * * *